United States Patent [19]

Sato

[11] 4,257,326

[45] Mar. 24, 1981

[54] LABEL POSITIONING MECHANISM FOR A LABEL PRINTING MACHINE

[75] Inventor: Yo Sato, Tokyo, Japan

[73] Assignee: Kabushiki Kaisha Sato Kenkyusho, Japan

[21] Appl. No.: 951,869

[22] Filed: Oct. 16, 1978

[51] Int. Cl.[3] ..... B41K 3/48

[52] U.S. Cl. ..... 101/288; 101/291; 226/90; 400/134.5; 400/600.2

[58] Field of Search ..... 101/288, 287, 291, 292; 226/89, 90; 400/600, 600.1–600.4, 134.2, 134.4, 134.5

[56] References Cited

U.S. PATENT DOCUMENTS

| | | | |
|---|---|---|---|
| 1,079,108 | 11/1913 | Chipperfield | 226/90 |
| 1,874,823 | 8/1932 | Smith | 400/600.4 |
| 2,321,014 | 6/1943 | Crosman | 400/600.4 |
| 2,425,172 | 8/1947 | Britten, Jr. | 400/600.4 |
| 2,710,188 | 6/1955 | Manley | 226/89 |
| 3,119,300 | 1/1964 | Barocela | 226/90 |
| 3,782,279 | 1/1974 | Carboni, Jr. et al. | 101/288 |
| 4,053,092 | 10/1977 | Edwards | 226/90 |

*Primary Examiner*—William Pieprz

*Attorney, Agent, or Firm*—Ostrolenk Faber, Gerb & Soffen

[57] ABSTRACT

A label positioning mechanism for use with a label printing machine: The label positioning mechanism includes a feed wheel which is rotatably mounted in the body of the printing machine and is formed on its circumference with a label strip advancing surface. A label positioning member is pivotally connected to the machine body such that it is rotatable toward and away from the label advancing surface of the feed wheel. Springs normally urge the label positioning member toward the feed wheel. There is an arm mechanism that has one end fixed to an operating shaft. The arm has another end that is pivotally connected to the label positioning member. The operating shaft is rotatably mounted in the machine body. The operating force of the operating shaft may be transmitted to the label positioning member when the operating shaft is actuated.

13 Claims, 3 Drawing Figures

LABEL POSITIONING MECHANISM FOR A LABEL PRINTING MACHINE

BACKGROUND OF THE INVENTION

1. Field of the Invention

The present invention relates to a label strip positioning mechanism for use with a label printing machine.

2. Description of the Prior Art

In a label printing and applying machine, in order to feed a continuous strip of labels onto the printing platen, a rotatable feed wheel includes teeth that engage slits that are formed in the continuous label strip. The label strip must be brought into contact with the feed wheel. A label strip positioning member in the body of the printing machine is moved to and from the label strip engaging periphery of the feed wheel. However, prior art label positioning mechanisms cannot reliably bring a continuous label strip into contact with the feed wheel or facilitating the operations of loading and unloading the label strip on and off the feed wheel.

SUMMARY OF THE INVENTION

It is an object of the present invention to provide a label positioning mechanism, for use with a printing machine, and which is free from the drawbacks of the prior art.

Another object of the invention is to provide such a label positioning mechanism which leaves a large clearance space through which the label strip can be threaded through the label printing machine.

It is a further object of the invention to ensure that the label strip is securely held to the feed wheel.

Another object of the present invention is to provide such a label positioning mechanism, in which a label positioning member can be moved toward and away from the label advancing surface of a feed wheel by the actuation of an operating shaft and in which the label positioning member is urged to the label advancing, peripheral surface of the feed wheel by biasing means so that the label strip can be biased against the feed wheel to ensure its feeding and further so that the loading and unloading of the label strip onto and off the feed wheel can be carried out easily and smoothly, while simplifying the overall construction of the label printing mechanism.

A label positioning mechanism according to the present invention is used with a label printing machine, which is operative to print labels that are removably adhered in series to a strip of backing paper. The label positioning mechanism comprises a feed wheel that is rotatably mounted in the body of the label printing machine and that is formed on its circumference with a label advancing surface, perhaps including feed pawls, and which is engageable with the label strip for advancing the strip in a preset direction. A label positioning member is pivotally connected to the body of the printing machine. This member is rotatable to a first position, where it is apart from the label advancing surface of said feed wheel. This defines an opening between the positioning member and the feed wheel for insertion of the label strip. The positioning member is also rotatable to a second position, where it is close to the feed wheel, but it is still placed to leave a clearance space substantially equal to the thickness of the label strip. Biasing means normally urge the label positioning member to the second named position, through the arm mechanism. An operating shaft is rotatably mounted to the body of the printing machine. There is an arm mechanism having one end fixed to the operating shaft and having another end pivotally connected to the label positioning member for transmitting the operating force of the operating shaft to the label positioning member when the shaft is rotated.

BRIEF DESCRIPTION OF THE DRAWINGS

Other objects and features of the present invention will become appaarent from the following description taken in conjunction with the accompanying drawings, in which.

DESCRIPTION OF THE PREFERRED EMBODIMENT

The label positioning mechanism according to the present invention may be used in a portable label printing machine of the type, for example, shown in U.S. Application Ser. No. 785,357, filed Apr. 7, 1977, now U.S. Pat. No. 4,125,074, incorporated herein by reference.

Figure 1:
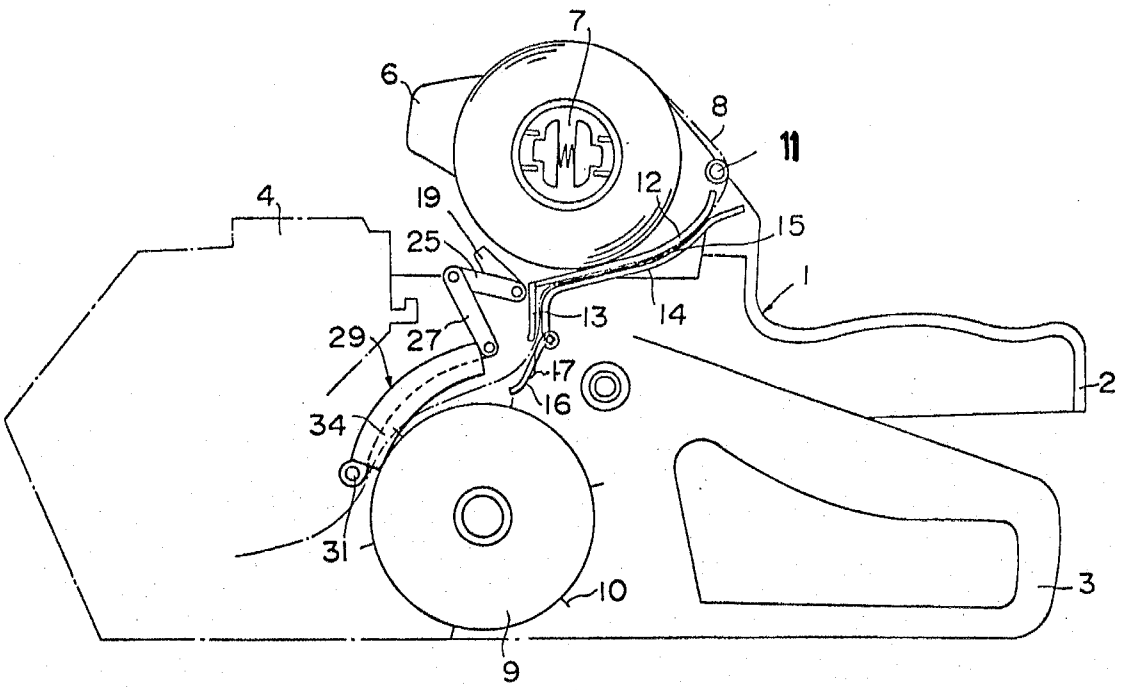
FIG. 1 is a simplified side elevational view of a label printing machine, of the portable type, in which the label positioning mechanism according to the present invention is used, and shown in the condition at which the label positioning member is apart from the label strip feed wheel.
Figure 2:
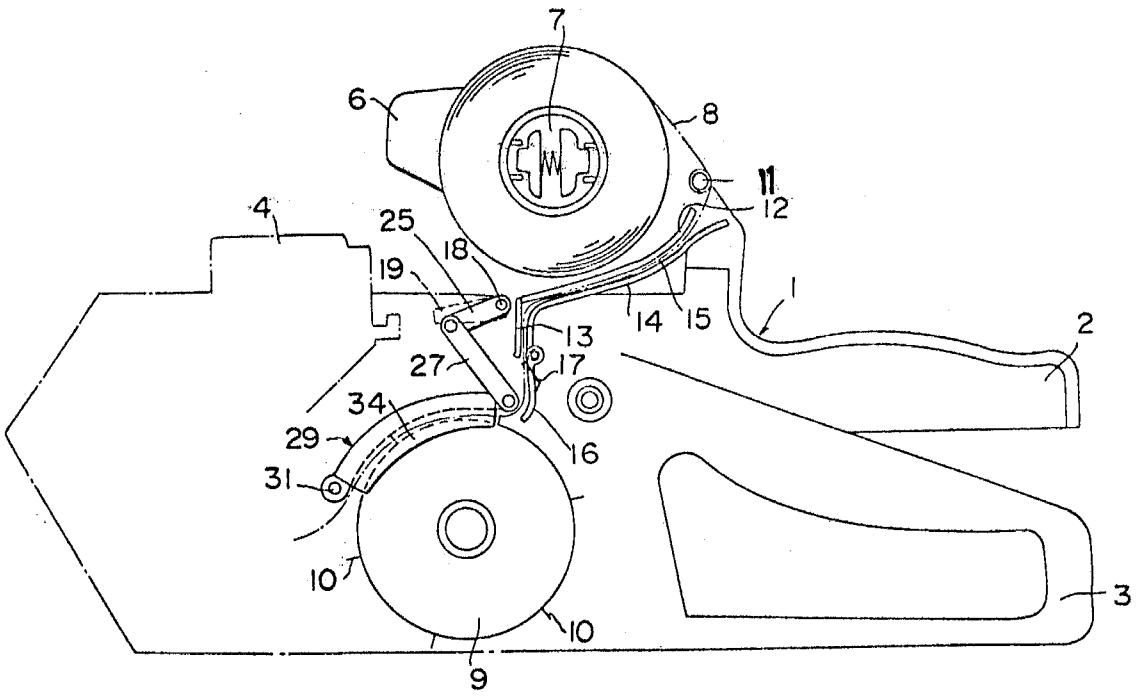
FIG. 2 is the same view as FIG. 1, with the machine in the condition at which the label positioning member is positioned close to the label advancing circumference of the feed wheel.
Figure 3:
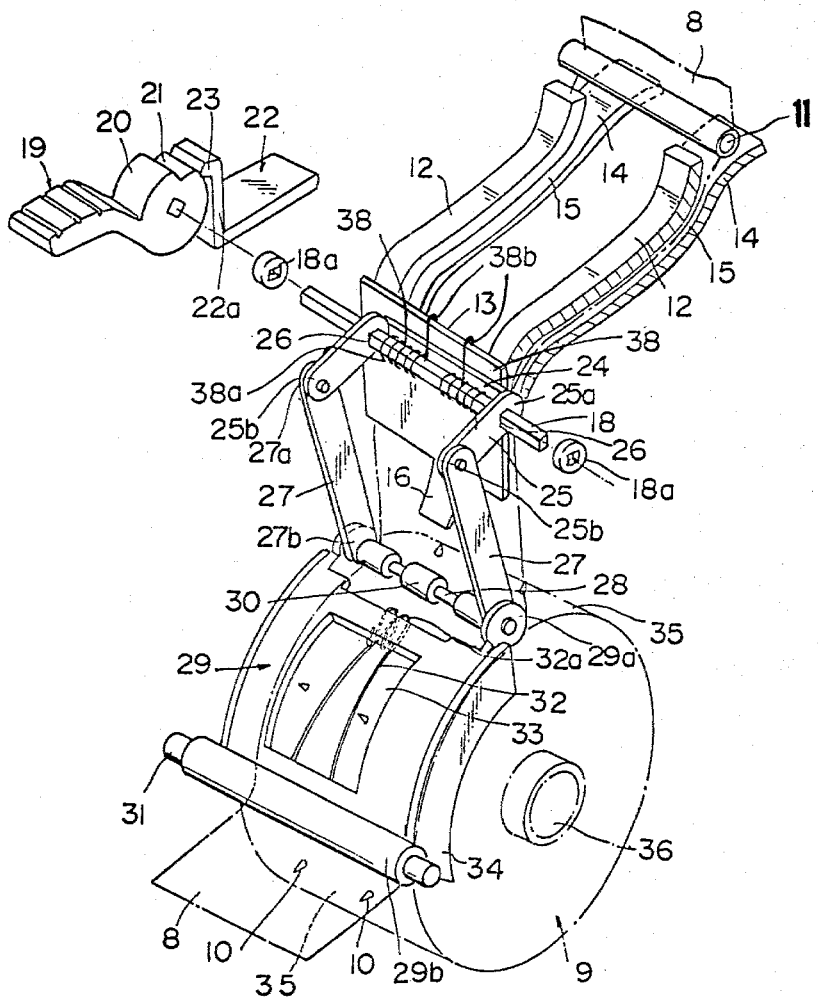
FIG. 3 is an enlarged, partially exploded, perspective view showing essential components of the label positioning mechanism according to the invention.

Referring to FIGS. 1–3, the body 1 of a label printing machine or hand labeler is equipped with a stationary grip 2, a hand lever 3 pivotable toward and away from the grip, a printing head 4 and a printing platen (not shown), all of which are required for the printing operations. The machine body 1 has an upper center portion that is formed integrally with a label strip holder side plate 6. This plate 6 is equipped at its center with a rolled label strip core retainer 7. Removably and rotatably attached to the core retainer 7, there is a continuous strip of labels 8 which is rolled on a core (not shown). The continuous label strip 8 is comprised of a number of labels which are arranged in a row along and are removably adhered to the surface of a strip of backing paper. This backing paper strip is formed at preset positions with slits (not shown) which are sized to be detachably retained by the feed pawls or teeth 10 of a later-described feed roller 9. See U.S. Application Ser. No. 926,704, filed July 20, 1978, incorporated herein by reference, for an example of such a label strip. The label holder side plate 6 is equipped at its rear end (or at its right hand side in FIG. 1) with a guide roller 11, over which the leading end of the continuous label strip 8 is guided.

At the upper portion of the machine body 1, there are a pair of spaced apart upper label inlet members 12. Each member 12 is integral with one of the side frames of the body 1 while leaving a preset clearance from the respective side frame of the body in the widthwise direction. Each upper label inlet member 12 has an upper end positioned in the vicinity of the guide roller 11 and has a lower end positioned in the vicinity of the upper end portion of a guide plate 13, described below. The intermediate portion of each upper label inlet member 12 between its ends is gently curved convexly along the top surface of the continuous label strip 8.

Below the upper label inlet members 12, there is a corresponding pair of lower label inlet members 14 which are also integral with the machine body 1 and they are concavely curved correspondingly along the bottom surface of the label strip and conformingly to the curvature of the upper members 12. A clearance 15 of a preset spacing is thus formed between the upper surfaces of the lower members 14 and the lower surfaces of the upper members 12. The clearance 15 has a height slightly greater than the thickness of the label strip 8. The upper end portions of both of the label inlet members 12 and 14 are respectively curved apart to leave a space large enough so that they can receive the leading end of the continuous label strip 8 between them without difficulty.

The guide plate 13 has a generally rectangular shape and depends from the front (at the left in FIG. 1) of the lower end portions of the lower label inlet members 14. A pressure tongue 16 is located at the back of the guide plate 13 and it is hingedly attached to and depends from the lower end portions of the lower label inlet members 14. The pressure tongue 16 is always biased by a torsion spring 17 in the clockwise direction to be brought into contact with the forwardly facing, back side of the guide plate 13, i.e. the side of plate 13 facing out of the clearance 15.

In front (to the left) of the guide plate 13 there is an operating shaft 18 of rectangular cross-section, which is rotatably mounted to the machine body 1 by means of two rollers 18*a*. As shown in FIG. 3, there is a lock lever 19 which is formed with a rectangular hole through it by which the lever is fixed to one end portion of the operating shaft 18. The lock lever 19 has a cylindrical main portion 20 that has an engagement notch 21 formed in its outer circumference. There is an L-shaped engagement member 22 which is fixed to the outside of the machine body 1. The member 22 includes an engagement projection 23 that is at the end of its upright leg 22*a*. The projection 23 moves into and out of engagement with the notch 21 through the raising and lowering of the lock lever 19. The upright leg 22*a* of the engagement member 22, which carries the projection 23 is made of an elastic material which facilitates the engagement and disengagement between the engagement notch 21 and the projection 23.

A pair of parallel operating arms 25 are fixedly attached to the operating shaft 18. The arms 25 are juxtaposed at a preset spacing, and they are connected by a bridge member 24 at their rear end portions 25*a*. Also, the arms 25 have aligned, correspondingly oriented rectanular holes 26 through them and the shaft 18 passes through the rectangular holes 26. The other forward end portions 25*b* of the operating arms 25 are arranged in front of and below the operating shaft 18.

A pair of connecting arms 27 are pivotally connected at their upper ends 27*a* to the respective forward end portions 25*b* of the operating arms 25. The arms 27 thus depend from the end portions 25*b* of the operating arms 25. The arms 27 have other lower ends 27*b* that are pivotally connected to the upper or rear end 29*a* of a label positioning member 29 through a long pin 28. Three guide rollers 30 are mounted equidistantly apart and rotatably on the long pin 28 for easing the feedng of the continuous label strip 8 past the pin 28.

The label positioning member 29 is made of a synthetic resin, or the like material. It is curved along the periphery of the feed wheel 9, described below. The label positioning member 29 is pivotally connected at its other lower or forward end 29*b* to the machine body 1 by a shaft 31. Thus, the positioning member pivots with respect to the machine body. There is mounted on the lower, feed wheel facing surface of the label positioning member 29 a label holding member 32 having an upper end 32*a* that is retained on the upper end 29*a* of the member 29 and having a lower end 32*b* that is retained on the lower end 29*b* of the member 29. The center portion of the label holding member 32 is exposed to the outside through an aperture 33 which is formed in the label positioning member 29. A pair of widthwise regulating side plates 34 depend from both side edges of the label positioning member 29 so as to regulate the widthwise play of the continuous label strip 8.

The label positioning member 29 is moved to approach and leave the feed wheel 9 of cylindrical shape above the continuous label strip 8. The feed wheel 9 is mounted to the machine body 1 by means of a shaft 36 such that the wheel 9 can be turned a preset distance by the manual squeezing of the hand lever 3 on the machine body 1. The peripheral circumference of the feed roller 9 acts as a label advancing surface. On this surface are formed, equidistantly spaced apart, a number of rows of feed pawls 10. Each feed pawl engages a slit in the label strip.

A pair of torsion springs 38 are wound on the center portion of the operating shaft 18. They have their respective first ends 38*a* retained on the upper edges of the operating arm 25 and their respective other ends 38*b* retained on the upper edge of the guide plate 13. As a result, both operating arms 25 are always biased to rotate counterclockwise about the operating shaft 18, as viewed in FIG. 2. The label positioning member 29 is biased to rotate clockwise about the shaft 31 by the above described action of the operating arms 25 so that the member 29 is continuously pushed toward the label advancing surface 35 of the feed wheel 9.

The loading and unloading operations for the continuous label strip 8 are now described. FIG. 1 shows the condition under which the lock lever 19 is at its raised position, wherein its engagement notch 21 is in engagement with the engagement projection 23 of the engagement member 22. In this condition, the forward ends 25*b* of the operating arms 25 are held in front of and above their rearward ends 25*a*, and the upper end 29*a* of the label positioning member 29 is held at the upper forward limit of its rotation. This establishes an open space between the member 29 and the label strip advancing surface 35 of the feed wheel 9.

With the mechanism in this condition, the continuous label strip 8, which is held on the core retainer 7, is unrolled therefrom, and its leading end is moved past the guide roller 11 into the clearance 15 between the upper and lower label inlet members 12 and 14 and is then further advanced along between the members 12 and 14. The leading end of the advancing label strip 8 is eventually moved into abutment against the rearwardly facing surface of the guide plate 13. The leading end of the label strip is turned down so that it can be advanced between the guide plate 13 and the pressure tongue 16. Since the pressure tongue 16 is being urged forwardly by the torsion spring 17, the leading end of the label strip 8 is guided over the upper surface of the pressure tongue 16, into the opening which is formed between the label positioning member 29 and the feed wheel 9. Then, the label strip 8 is advanced along the label advancing surface 35 of the feed wheel 9 until it is fed past the feed wheel from between the surface 35 and the other forward end 29*b* of the label positioning member 29.

Now that the label strip has been positioned, the lock lever 19 is pivoted down, as shown in FIG. 2, which releases the engagement between the notch 21 and the projection 23. This also turns the operating shaft 18 counterclockwise, as viewed in FIG. 1, and the operating arms 25 are accordingly turned counterclockwise about the operating shaft 18. The rotation of the operating arms 25 can take place promptly and smoothly because the biasing forces of the torsion springs 38 act in the direction to promote this rotation of the operating arms 25.

Meanwhile, the connecting arms 27 are moved downward by the counterclockwise rotation of the operating arms 25 so that the label positioning member 29 is turned clockwise, as viewed in FIG. 1, about the shaft 31 until it pushes the continuous label strip 8 onto the label advancing surface 35 of the feed wheel 9, as can be seen in FIGS. 2 and 3. The pushing by the label positioning member 29 can be reliably accomplished because the biasing forces of the torsion springs 38 act to bias the connecting arms 27 downwardly, as viewed in FIG. 2, through the operating arms 25.

Under the just described condition of the positioning member 29, when the hand lever 3 of the label printing machine is squeezed, the feed wheel 9 is turned a preset distance and this feeds the continuous label strip 8 in the desired direction through the action of the pawls 10 of the feed wheel 9 on the slits of the label strip.

Now, unloading of the continuous label strip 8 from the feed wheel 9 is described. When the lock lever 19 is raised from its down position of FIG. 2, the operating shaft 18 is turned clockwise, as viewed in FIG. 2. The operating arms 25 are accordingly turned clockwise about the operating shaft 18 so that their ends 25*b* are held at the upper limit of their rotations, by the engagement between the notch 21 of the lock lever 19 and the projection 23 of the engagement member 22.

During this rotation of the operating arms 25, the connecting arms 27 are pulled upward so that the label positioning member 29 is turned counterclockwise, as viewed in FIG. 2, about the shaft 31. As a result, the aforementioned opening is again formed between the member 29 and the feed wheel 9, and the elements are thus restored to the initial condition of FIG. 1.

If the portion of the continuous label strip 8 in the vicinity of the upper ends of the upper and lower label inlet members 12 and 14 is pulled upward, the whole label strip 8 can be taken out of the machine body 1 by way of that opening, the pressure tongue 16, the guide plate 13 and the clearance 15 between the inlet members 12 and 14, in the sequence recited.

The following advantages of the label positioning mechanism according to the present invention can be realized.

First, since the label positioning member is urged toward the feed wheel by the biasing forces of elastic members, the continuous label strip is always pushed against the feed wheel, so that the label strip can be fed without fail in accordance with the rotation of the feed wheel.

Moreover, since the label positioning member 29 is capable of approaching and leaving the label advancing surface 35 of the feed wheel 9, loding and unloading of the label strip onto and off the feed wheel can be accomplished easily. This movement of the member 29 is of further advantage in case the labels have prematurely or improperly peeled off their backing strip and have adhered to the feed wheel, because even in this case, the labels can be removed without any difficulty.

The movement of the label positioning member to and from the feed wheel can be carried out easily and promptly, simply by actuating the operating shaft 18.

Since the pushing of the label positioning member 29 onto the feed wheel 9 is accomplished by the biasing forces of the elastic members 38, it can take place smoothly and promptly.

There are five major components of the label positioning mechanism of the present invention, namely, the label positioning member, the arm mechanism, the operating shaft, the elastic member and the feed wheel. Thus, the number of parts required for the label positioning mechanism is relatively small, simplifying its construction and rendering the label positioning mechanism of the invention suitable for mass production.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A label strip positioning mechanism for use with a label printing machine, wherein said label printing machine comprises:

a machine body;

a feed wheel mounted rotatably in said machine body and having a periphery comprised of a label advancing surface which is engageable with the label strip for advancing the label strip in a preset direction as said feel wheel is rotated; means for rotating said feed wheel in the preset direction;

said label strip positioning mechanism comprising:

a label strip positioning member supported in said machine body and shaped to have a surface that cooperates with said feed wheel periphery, when said positioning member is at a first position close to said feed wheel periphery, to define a first clearance between said positioning member surface and said feed wheel periphery, said clearance having a spacing approximating the thickness of a label strip to be advanced by said feed wheel; said positioning member having a second position further from said feed wheel where a larger second clearance is defined between said feed wheel periphery and said positioning member surface;

an operating shaft rotatably mounted to said machine body; an arm mechanism having one portion fixed to said shaft and having a second portion, spaced from said first portion, and attached to said positioning member at a first loction on said positioning member; said positioning member being pivotally attached to said machine body at a second location on said positioning member which is spaced from said first location thereon, whereby said positioning member is pivoted between its said positions; said positioning member first location being upstream in the preset direction of rotation of said feed wheel from said positioning member second location;

said arm mechanism being movable by rotation of said shaft for moving said positioning member to said first position close to said feed wheel and for also moving said positioning member to said second position a pressure tongue which is spaced from and generally upstream of said positioning member surface with respect to said feed wheel preset direction when said positioning member is in said second position thereof and which is near to said feed wheel for defining an entrance for a label strip toward said feed wheel between said pressure tongue and said feed wheel; said pressure tongue being so shaped and extending near to said feed wheel as to guide a label strip in the preset direction and to generally obstruct movement of a label strip counter to the preset direction.

2. The label strip positioning mechanism of claim 1, further comprising printing means for printing labels on a label and strip, said printing means being supported on said machine body.

3. The label strip positioning mechanism of claim 1, further comprising biasing means for normally urging said positioning member to said first position thereof.

4. The label strip positioning mechanism of claim 3, wherein said arm mechanism is pivotally attached to said positioning member.

5. The label strip positioning mechanism of claim 4, further comprising locking lever means connected to said shaft for locking said shaft to hold said positioning member in said first position thereof; said locking lever means being operable to release said shaft to rotate, thereby enabling said positioning member to be moved to said second position thereof by rotation of said operating shaft.

6. The label strip positioning mechanism of claim 4, wherein said arm mechanism includes:

an operating arm that is fixed at said arm mechanism one portion to said shaft;

a connecting arm that is pivotally connected to said positioning member at said arm mechanism second portion;

said operating and said connecting arms being pivotally connected to each other at a location spaced from said arm mechanism one and second portions.

7. The label strip positioning mechanism of claim 6, further comprising locking lever means connected to said shaft for locking said shaft to hold said positioning member in said first position thereof; said locking lever means being operable to release said shaft to rotate, thereby enabling said positioning member to be moved to said second position thereof by rotation of said operating shaft.

8. The label strip positioning mechanism of claim 8, wherein said biasing means comprises a torsion spring which biases said operating arm toward said feed wheel.

9. The label strip positioning mechanism of claim 6, wherein there are a pair of said operating arms and a pair of said connecting arms; one said arm of each said pair being connected to a respective one said arm of the other said pair;

a bridge member connecting said operating arms together to move together.

10. The label strip positioning mechanism of claim 9, wherein said biasing means comprises torsion spring means which bias said operating arms toward said feed wheel; said torsion spring means rest on the other hand on a member which is independent of said operating arms.

11. The label strip positioning mechanism of claim 1, further comprising biasing means for normally urging said pressure tongue to a position thereof for obstructing movement of a label strip counter to the preset direction and for enabling said pressure tongue to resiliently deflect from that position upon a label strip engaging said pressure tongue, whereby said pressure tongue urges a label strip, which engages said pressure tongue, in the preset direction.

12. The label strip positioning mechanism of claim 11, further comprising a label guide plate supported on said machine body and shaped and positioned for guiding entrance of a label strip into said machine body and toward said feed wheel; said pressure tongue being connected with said machine body and being at the part of said guide plate that is toward said feed wheel, such that a label strip fed off said entrance guide plate and toward said feed wheel will be prevented by said pressure tongue from moving counter to the preset direction.

13. The label strip positioning mechanism of either of claims 1 or 12, wherein said positioning member includes spaced apart side plates thereon arranged along the sides of said positioning member surface and extending toward said feed wheel and said side plates being positioned and shaped for defining the sides of the pathway of travel of a label strip past said positioning member.

* * * * *